US008256437B2

(12) United States Patent
Gueret

(10) Patent No.: US 8,256,437 B2
(45) Date of Patent: Sep. 4, 2012

(54) MASCARA BRUSH INCLUDING BRISTLES OF VARIOUS DIAMETERS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 321 days.

(21) Appl. No.: 12/533,327

(22) Filed: Jul. 31, 2009

(65) Prior Publication Data

US 2010/0059080 A1 Mar. 11, 2010

Related U.S. Application Data

(60) Provisional application No. 61/091,920, filed on Aug. 26, 2008.

(30) Foreign Application Priority Data

Jul. 31, 2008 (FR) ..... 08 04381

(51) Int. Cl.
*A45D 40/26* (2006.01)

(52) U.S. Cl. ..... 132/218; 15/206; 15/DIG. 6

(58) Field of Classification Search ..... 132/218, 132/313; 401/129, 118; 15/206, 207.2, DIG. 5, 15/DIG. 6
See application file for complete search history.

(56) References Cited

U.S. PATENT DOCUMENTS

| | | | | |
|---|---|---|---|---|
| 4,861,179 | A | 8/1989 | Schrepf et al. | |
| 5,063,947 | A * | 11/1991 | Gueret | 132/218 |
| 5,165,760 | A * | 11/1992 | Gueret | 300/21 |
| 5,197,497 | A | 3/1993 | Gueret | |
| 5,345,644 | A * | 9/1994 | Gueret | 15/160 |
| 5,482,059 | A | 1/1996 | Miraglia | |
| 5,613,258 | A | 3/1997 | Hilfinger et al. | |
| 5,709,230 | A * | 1/1998 | Miraglia | 132/218 |
| 5,918,994 | A * | 7/1999 | Gueret | 401/122 |
| 5,934,292 | A | 8/1999 | Gueret | |
| 6,390,708 | B1 | 5/2002 | Gueret | |
| 6,494,215 | B2 * | 12/2002 | Gueret | 132/218 |
| 7,125,188 | B2 * | 10/2006 | Gueret | 401/129 |
| 7,171,969 | B2 * | 2/2007 | Gueret | 132/218 |
| 2003/0200979 | A1 | 10/2003 | Montoli et al. | |
| 2004/0009028 | A1 * | 1/2004 | Gueret | 401/129 |
| 2004/0134507 | A1 | 7/2004 | Gueret | |
| 2005/0145262 | A1 | 7/2005 | Dunton et al. | |

(Continued)

FOREIGN PATENT DOCUMENTS

GB 2170996 A * 8/1986

(Continued)

OTHER PUBLICATIONS

French Search Report for FR 0804381, dated Mar. 9, 2009.

*Primary Examiner* — Todd Manahan
*Assistant Examiner* — Jennifer Gill
(74) *Attorney, Agent, or Firm* — Oliff & Berridge, PLC

(57) ABSTRACT

An applicator for applying a composition to the eyelashes or the eyebrows, the applicator having a brush with a twisted core and including at least two segments. Each segment includes a plurality of bristles having a common diameter associated with the segment, the bristles being held by the twisted core. The common diameter associated with each of the at least two segments increases for each segment towards a distal end of the twisted core.

21 Claims, 3 Drawing Sheets

U.S. PATENT DOCUMENTS

| | | | | |
|---|---|---|---|---|
| 2005/0257802 | A1* | 11/2005 | Yasuda | 132/218 |
| 2006/0056903 | A1* | 3/2006 | Gueret | 401/129 |
| 2006/0272667 | A1* | 12/2006 | Wyatt et al. | 132/218 |
| 2007/0221241 | A1 | 9/2007 | Gueret | |
| 2008/0099034 | A1 | 5/2008 | Dieudonat | |

FOREIGN PATENT DOCUMENTS

| | | | |
|---|---|---|---|
| WO | WO 95/17837 | | 7/1995 |
| WO | WO9517837 | * | 7/1995 |
| WO | WO 96/31143 | | 10/1996 |
| WO | WO9631143 | * | 10/1996 |

* cited by examiner

MASCARA BRUSH INCLUDING BRISTLES OF VARIOUS DIAMETERS

This application claims benefit of U.S. Provisional Application No. 61/091,920, filed Aug. 26, 2008, the contents of which are incorporated herein by reference. This application also claims benefit of priority under 35 U.S.C. §119 to French Patent Application No. FR 0804381, filed Jul. 31, 2008, the contents of which are also incorporated herein by reference.

TECHNICAL FIELD

The present disclosure relates to applicators comprising a twisted-core brush for applying a cosmetic composition to the eyelashes or the eyebrows.

BACKGROUND

Twisted-core brushes are conventionally manufactured by inserting bristles between two branches of a wire that is folded in half, and then by twisting the branches, thereby causing the ends of the bristles to extend in helical layers.

Brushes have been manufactured with a very wide range of bristles for the purpose of benefiting from properties that are satisfactory in terms of taking the composition and of applying it to the eyelashes.

It has thus been proposed to use mixtures of bristles having different stiffness and/or different lengths.

U.S. Pat. No. 4,861,179 describes a mascara brush comprising a mixture of stiff and soft bristles in random manner along the brush.

U.S. Pat. Nos. 5,197,497 and 5,165,760 also describe brushes having mixtures of bristles of different diameters and different lengths.

US application No. 2005/0145262 discloses a manufacturing method that makes it possible to obtain a brush having a substantially uniform mixture of short and long bristles of different diameters.

U.S. Pat. Nos. 5,482,059 and 5,709,230 describe mascara brushes having stiff and soft bristles at two respective end segments, and a mixture of stiff and soft bristles in the intermediate segment.

WO 95/17837 discloses a brush comprising segments having different bristle diameters.

BRIEF SUMMARY OF THE DISCLOSURE

There exists a desire to improve still further applicators comprising twisted-core brushes.

Systems and methods of the present disclosure seek to satisfy this desire.

In the following description, certain embodiments of the present invention will become evident. It should be understood that the invention, in its broadest sense, could be practiced without having one or more features of these embodiments. In other words, these embodiments are merely exemplary.

Exemplary embodiments of the invention provide an applicator for applying a composition to the eyelashes or the eyebrows. The applicator includes a brush having a twisted core and comprising at least two segments, for example, at least three, each segment including a plurality of bristles having a common diameter associated with the segment (where the diameter of a bristle is the diameter of the circle in which its section can be inscribed), and being held by the twisted core.

The common diameter associated with each of the at least two segments increases for each segment towards a distal end of the twisted core.

Within any one segment of bristles, the bristles may be of material that is different or identical and/or of section that is different or identical and/or of color that is different or identical, and/or of length that is different or identical.

The segments may have or may not have the same number of bristles, and/or the same length of bristles, and/or the same length along the core.

The present disclosure makes it possible to cause stiffness to vary, in progressive manner, along the brush, e.g. so as to benefit from a distal portion that is stiffer or more flexible than the remainder of the brush, as a function of the desired makeup effect.

The present disclosure may also improve the flow of composition around the brush while it is in the container, and in particular it may reduce the pistoning phenomenon on passing through the wiper as a result of some of the bristles being more flexible, for example.

The present disclosure may also allow, in particular with at least one segment of bristles of a larger diameter, and whose bristle tips are spaced further from one another, better loading of the brush with composition in particular the distal part of the brush when the segment comprising the bristles of largest diameter is adjacent to the distal end of the brush. The bristles of largest diameter may also allow a better loading of the brush with composition by way of a larger exterior surface.

The bristles of said segments may be made out of the same material or out of different materials.

The bristles of said segments may be made with the same shape in cross-section or with different shapes.

The diameter of the bristles of said segments may lie in the range $^{2}/_{100}$ millimeters (mm) to $^{40}/_{100}$ mm, e.g., in the range $^{6}/_{100}$ mm to $^{36}/_{100}$ mm.

The diameter of the bristles of a segment may differ from the diameter of the bristles of a consecutive segment by a value lying in the range $^{1}/_{100}$ mm to $^{10}/_{100}$ mm, e.g., in the range $^{2}/_{100}$ mm to $^{8}/_{100}$ mm.

The length of a segment, measured along the core, may lie in the range 1 mm to 10 mm.

The applicator may comprise 4 to 25 segments having bristles that have different respective diameters.

The number of bristles per segment may lie in the range 2 to 300, e.g., in the range 10 to 60.

The envelope surface of the brush need not be circularly symmetrical about the longitudinal axis of the core, even when straightened out for observation purposes, where appropriate.

The cross-section of the envelope surface may vary as a function of the diameter of the bristles.

The present disclosure also provides a packaging and applicator device comprising a container containing the composition for application to the eyelashes or the eyebrows, and an applicator as defined above.

The present disclosure also provides a method of manufacturing a twisted-core brush of an applicator as defined above, in which method at least two, in particular at least three tufts of same-diameter bristles for forming said segments are disposed between two branches of a wire, and said branches are twisted together.

The present disclosure also provides an applicator for applying a composition. The applicator includes a brush comprising a twisted core and at least three segments, each segment comprising a plurality of bristles having a common diameter and held by the core. Except for a proximal segment at a proximal end and a distal segment at a distal end of the brush, the common diameter of the plurality of bristles for each of the at least three segments alternates between a larger diameter and a smaller diameter. In some embodiments, the common diameter for bristles of a given segment, in some embodiments all segments other than the end segments, may be larger, respectively smaller, than the bristle diameter of the adjacent segments. It is possible to have, for example, consecutive segments having bristle diameters that are alternatingly larger and smaller than a reference diameter. Each segment may be similarly configured to result in such alternation of the diameters along the segments.

The present disclosure also provides, independently or in combination with the foregoing, an applicator for applying a composition. The applicator includes a brush having a twisted core and at least two segments, for example, at least three segments, each segment comprising a plurality of bristles held by the core. The plurality of bristles associated with each of the at least two segments differ in cross-sectional shape between each of the at least two segments. In such embodiments, each plurality of bristles associated with each segment may or may not have a common diameter, as desired.

All bristles of a segment may have in particular a cross-section of a shape selected from the following list which is exemplary and not limiting: full or hollow, circular or non-circular, polygonal, regular or not, in particular triangular, square, rectangular, octagonal, as a parallelogram, rhombus, oval, reniform, cross shaped, with at least one capillary groove, for example "Z", "I", or "H" shaped.

Having a cross-section that changes from one segment to another, with or without a variation of the bristle diameter, may allow modifications of the features of the brush, for example to have a better capability for loading the eyelashes with product via the end of the brush, with the help of bristles capable of being loaded with more of the cosmetic composition. The choice of cross-section may also change orientation of the bristles, which may become more or less random. For example, the use of bristles with a non-circular cross-section on at least one segment may decrease the effect of turns. In some embodiment one segment may maintain the circular cross-section bristles, in order to benefit from the turn effect.

Aside from the features set forth above, the subject matter disclosed herein could include a number of alternative and/or additional features such as those explained hereinafter. It is to be understood that both the foregoing description and the following description are exemplary only.

BRIEF DESCRIPTION OF THE DRAWINGS

The present disclosure can be better understood on reading the following detailed description of non-limiting embodiments thereof, and on examining the accompanying drawings, in which.

DETAILED DESCRIPTION

Figure 1:
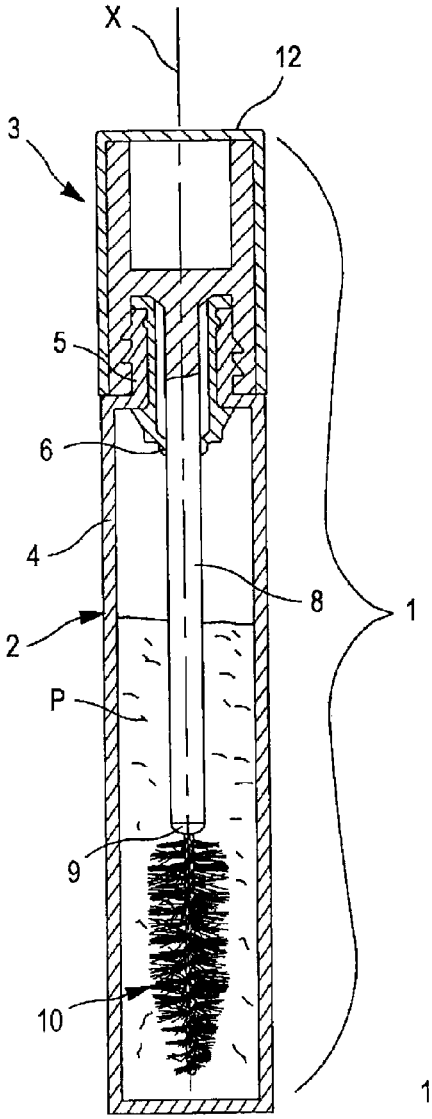
FIG. 1 is a diagrammatic longitudinal section view showing an embodiment of a packaging and applicator device consistent with some embodiments of the present disclosure.

Reference will now be made in detail to a few exemplary embodiments of the invention. Wherever possible, the same reference numbers are used in the drawings and the description to refer to the same or like parts.

The packaging and applicator device 1 shown in FIG. 1 comprises a container 2 containing a composition P for application, and an applicator 3 for applying the composition P to the eyelashes or the eyebrows.

By way of example, the composition P is mascara, black or of some other color, or a care product for the eyelashes or the eyebrows.

The container 2 comprises a body 4 that is provided with a neck 5 in which there is mounted a wiper member 6 that makes it possible to remove any excess composition on the applicator 3, while said applicator is being removed from the container 2.

The wiper member 6 may be of any known type, and, by way of example, it includes a wiper lip of annular shape comprising an elastomer.

The wiper member may also include a double, adjustable, and/or undulating block of foam, as described in patent publications of the named inventor, in particular US applications No. 2006/0233588, 2009/0028627 and 2008/0052969, and U.S. Pat. Nos. 6,375,374 and 6,261,017, incorporated herein by reference.

The applicator 3 comprises a stem 8 carrying a brush 10 at one end 9 (i.e., distal end), and connected to a handle 12 at its opposite end (i.e., proximal), the handle 12 also forming a closure cap for closing the container 2 in leak-tight manner.

Figure 2:
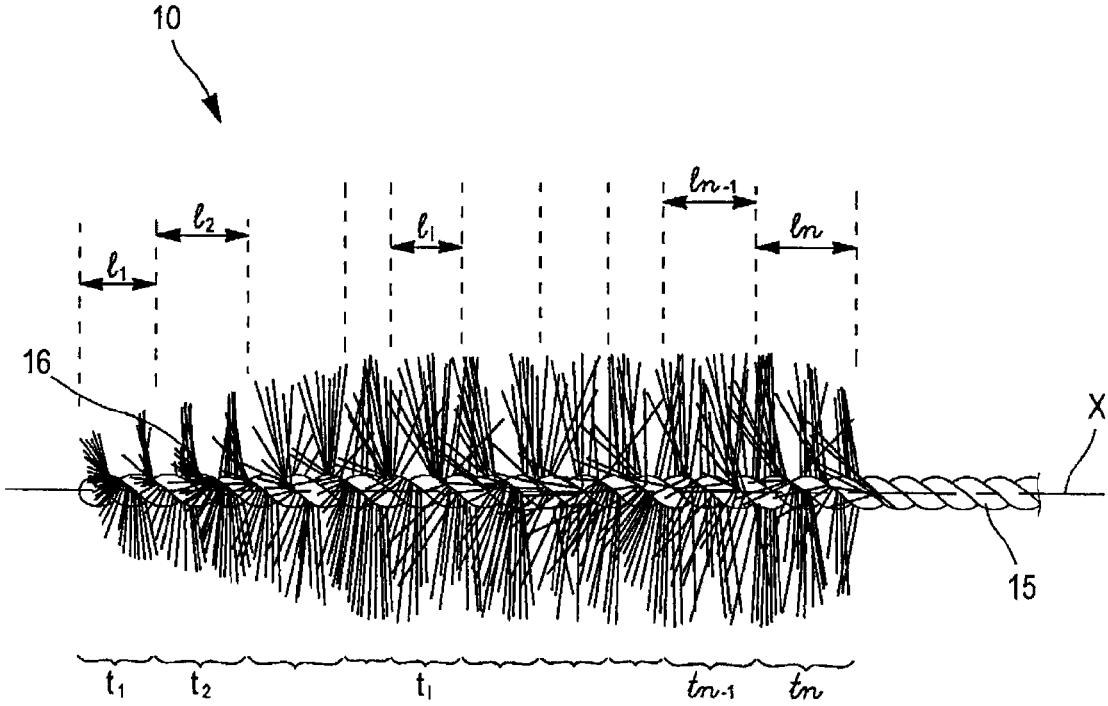
FIG. 2 is a side view of an embodiment of a brush shown in isolation and according to some embodiments of the present disclosure.

With reference to FIG. 2, it can be seen that the brush 10 comprises a twisted core 15 carrying bristles 16.

The core 15 may be fastened in various ways on the stem 8, e.g. being inserted into a housing of the stem 8, not shown in FIG. 1, formed at the end of said stem.

The stem 8 may present a cross-section that is circular, or of any other desired shape (e.g., rectangular).

In accordance with the present disclosure, along the core 15, the brush 10 comprises a plurality of segments (e.g., at least two, at least three, etc.) $t_1$ to $t_n$, each of the segments t comprising a plurality of bristles 16 having a common diameter d within the segment t. The common diameter d of the bristles 16 for each segment $t_1$ to $t_n$ increase towards a distal end of brush 10, with $n \geqq 3$, for example, n lying in the range 4 to 25.

In other words, within each segment $t_i$, with integer i lying in the range 1 to n, the bristles are of substantially the same diameter (i.e., "substantially" indicating within manufacturing tolerances). The length $l_i$ of a segment $t_i$ may be different from the length $l_k$ of another segment $t_k$, with k being different from i.

In accordance with exemplary embodiments of the invention, the diameters $d_t$ of the bristles 16 of the segments $t_i$ vary from one end (e.g., proximal end) to the other end (e.g., distal end) of the brush 10, along the longitudinal axis X of said brush 10. Thus, by way of example, $d_1<d_2< \ldots <d_n$. It is possible to have segments having respective bristle diameters that increase from one end of the brush 10 to the other for at least two, three, or more consecutive segments, e.g., the common diameters d for bristles 16 of the respective segments t increasing towards a distal end of the brush 10. Therefore, in some embodiments a segment t with bristles 16 having a largest diameter may be for example, situated at the distal end of the brush 10.

It is also possible to have $d_1<d_2< \ldots <d_j$ and $d_j>d_{j+1}>d_n$ or $d_1>d_2> \ldots >d_j$ and $d_j<d_{j+1}< \ldots <d_n$, with integer i lying in the range 2 to n−1.

It is also possible to have firstly $d_{j-1}<d_j<d_{j+1}$, and secondly $d_j$ to $d_{j-2}$ and/or $d_{j+2}$ to $d_n$ in increasing, decreasing, or any order.

It is also possible to provide segments t having respective bristle diameters d that alternatingly increase then decrease, or alternatively decrease then increase, for at least three consecutive segments, towards a distal end of the brush 10. In other words, according to some embodiments, segments may have bristle diameters d alternatingly larger and smaller than a reference diameter.

It is thereby possible to have $d_j>d_{j-1}$ and $d_j>d_{j+1}$, respectively $d_j<d_{j-1}$ and $d_j<d_{j+1}$, with $d_{j+1}>d_{j-1}$ or $d_{j+1}<d_{j-1}$ with integer j lying in the range 2 to n−1. With in particular, $d_{j-1}<d_r$, $d_j>d_r$ and $d_{j+1}<d_r$, or $d_{j-1}>d_r$, $d_j<d_r$ and $d_{j+1}>d_r$, with integer i lying in the range 2 to n−1, $d_r$ being a reference diameter, The segments may be of substantially similar (i.e., to within manufacturing tolerances) or different respective lengths.

Figure 3:
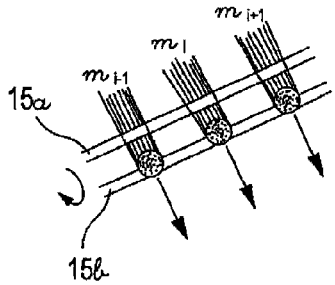
FIG. 3 is a diagrammatic view showing an exemplary step in the manufacture of the brush according to some embodiments of the present disclosure.

In order to manufacture the brush 10, a plurality of tufts $m_i$ may be placed between the two branches 15*a* and 15*b* for forming the core 15, before twisting the two branches 15*a* and 15*b* together with a right-handed twist or a left-handed twist, as shown in FIG. 3. Each tuft $m_i$ comprises a bundle of bristles 16 of common diameter d, and the number of bristles 16 per tuft may vary from one tuft to another. In FIG. 3, the tufts $m_{i-1}$, $m_i$ and $m_{i+1}$ are for forming the segments $t_{i-1}$, $t_i$, and $t_{i+1}$, respectively. The tufts $m_i$ may be held together by adhesive and/or other suitable materials while being inserted between the branches 15*a* and 15*b*.

Figure 5:
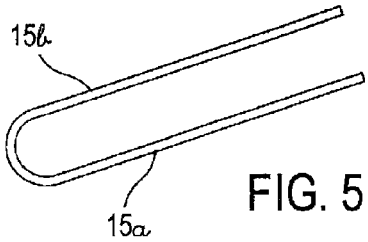
FIGS. 5 and 6 are examples of some wires that are suitable for being used in manufacturing the core of a brush according to some embodiments of the present disclosure.
Figure 6:
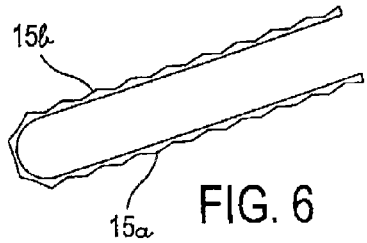

The number of bristles 16 per tuft $m_i$ may vary, e.g. lying in the range 10 to 200. The two branches 15*a* and 15*b* may be portions of a piece of wire that is folded in half, as shown in FIG. 5. The wire may comprise a constant circular section e.g. of diameter lying in the range 0.35 mm to 0.9 mm.

Where appropriate, the wire used may include a diameter that varies and/or presents surface irregularities, e.g., as shown in FIG. 6. This may contribute to reducing or limiting the spiral effect along the brush, e.g., by imparting a more uniform distribution for the ends of the bristles.

The ends of the tufts may possibly be ground using a grinder, e.g., a rotating grinder, to result in a tip/end of a desired shape.

Figure 4A:
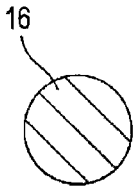
FIGS. 4A to 4G are cross-sections of examples of some bristles that are suitable for being used in manufacturing a brush according to some embodiments of the present disclosure.
Figure 4B:
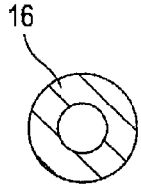
Figure 4C:
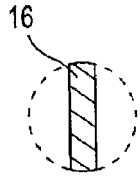
Figure 4D:
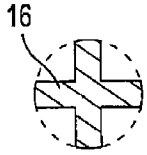
Figure 4E:
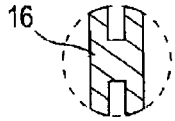
Figure 4F:
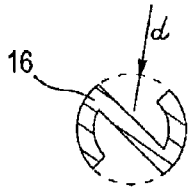
Figure 4G:
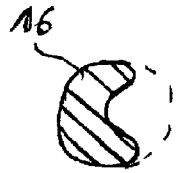

The bristles 16 used within a segment may have any cross-section, e.g. solid circular, as shown in FIG. 4A; hollow, of any section, in particular circular, as shown in FIG. 4B; flat, in particular rectangular, as shown in FIG. 4C; cross shaped, as shown in FIG. 4D; with one or more capillary grooves, as shown in FIG. 4E; with one or more hinged-together portions, as shown in FIG. 4F, or reniform, as shown in FIG. 4G; naturally other sections also being possible, as described in patent publications of the named inventor.

For purposes of the present disclosure, unless stated otherwise, the diameter of a bristle is considered as being the diameter of the smallest circle in which its section can be inscribed.

In some embodiments, the bristles 16 may have a diameter d that varies over a length of the bristle, in which case, the diameter of the bristle shall be determined by the mean diameter over the bristle length.

The bristles may also be rectilinear or they may have an undulating shape, as desired.

The bristles 16 may comprise any suitable material, and in some embodiments, a synthetic material, e.g. thermoplastic, e.g. a polyolefin such as polyethylene, polypropylene, polyethylene terephthalate (PET), polyoxymethylene (POM), polyimide (PA), polystyrene (PS), this list not being limiting.

From one segment t to another, the bristles 16 may be the same color or different colors (e.g., to indicate or otherwise accentuate differences in diameter).

From one segment t to another, bristle cross-sections may be substantially similar or may comprise different shapes. For example moving along the core 15 towards the distal end of the brush 10, the cross-section of the bristles may differ from one segment to another, along the segments t.

A brush 10 according to some embodiments may have, for example, a segment t comprising bristles 16 with a number of capillary grooves, the number of grooves decreasing or increasing, as desired, from one segment to the next towards the distal end.

From one segment to another, different cross-sectional shapes of bristles 16 for each segment t, may allow, for example, an increase in the rigidity of the bristles 16 towards the distal end.

The cross-section of the bristles 16 in each segment may have, for example, a surface area which increases or decreases, as desired, from one segment t to another, towards the distal end.

In some embodiments of the present disclosure, the brush 10 comprises at least two segments with the bristles 16 of each segment having different cross-sections. Such bristles 16 have, in accordance with some embodiments, different diameters. They may also have, in accordance with some embodiment, the same diameter.

From one segment to another, the bristles 16 may comprise the same materials or, alternatively may comprise different materials. For example, in some embodiments, all of the bristles 16 of the brush 10 may be made out of the same material.

The brush 10 may be subjected to various treatments, for example, to modify the shape of an envelope surface associated with the brush 10, e.g., to impart thereto a shape that is not circularly symmetrical about the longitudinal axis of the core 15.

By way of example, FIGS. 7A to 7I show various examples of cross-sections for the envelope surface E of the brush, the envelope surface E being defined by a geometrical surface defined by the free ends of the bristles 16.

A conventionally shaped brush presents an envelope surface E that is circularly cylindrical, possibly with a frusto-conical portion at the front, at its end remote from the stem.

Figure 7A:
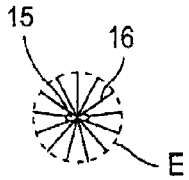
FIGS. 7A to 7I are exemplary cross-sectional drawings showing various examples of envelope surfaces for a brush according to some embodiments of the present disclosure.
Figure 7B:
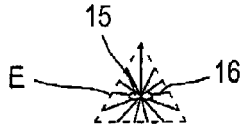
Figure 7F:
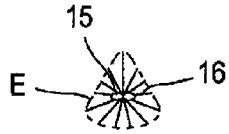
Figure 7G:
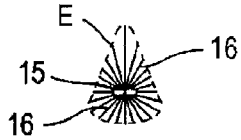
Figure 7C:
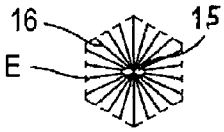
Figure 7E:
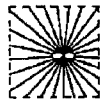
Figure 7D:
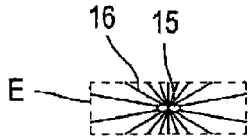

Over at least a fraction of the length of the brush 10, e.g. over more than one fourth of the length of the portion of the core 15 carrying the bristles 16, the envelope surface E of brushes consistent with the present disclosure may have a section that is circular, as shown in FIG. 7A, or that is polygonal and optionally regular, e.g. substantially triangular, as shown in FIG. 7B, hexagonal, as shown in FIG. 7C, rectangular, as shown in FIG. 7D, or any other desirable cross-section.

Within a cross-section, the core 15 may be centered or off-center, as shown in FIG. 7E.

The envelope surface E of the brush 10 may also have a cross-section in the shape of a water droplet of greater or lesser height, as shown in FIGS. 7F and 7G.

Figure 7H:
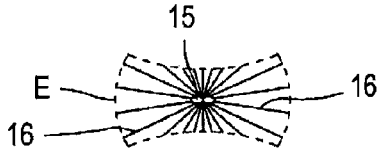

One or more indentations may be formed on one or more faces of the brush 10, as shown in FIG. 7H.

Figure 7I:
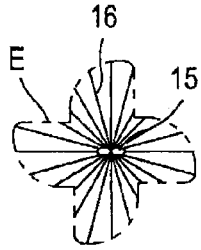

Notches may be formed on the brush 10, as shown in FIG. 7I. Envelope surfaces E of other shapes are possible, e.g. as described in the publications of the named inventor.

Figure 8A:
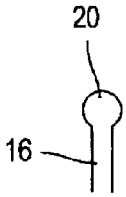
FIGS. 8A to 8D show examples of treatments for the ends of the bristles according to some embodiments of the present disclosure.
Figure 8B:
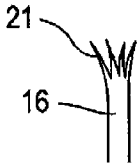

The brush 10 may be subjected to any treatment that seeks to modify the ends of the bristles, for example, forming a sphere or ball 20 at the end of each bristle, as shown in FIG. 8A, or forming a fork 21, as shown in FIG. 8B. Where a sphere or ball is formed at the end of a bristle 16, the term "diameter" refers to the diameter of the bristle before the treatment leading to the formation of the sphere or ball.

Figure 8C:
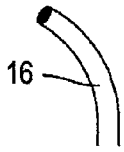
Figure 8D:
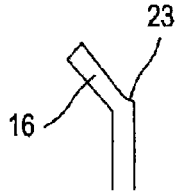

In some embodiments, the bristles 16 of the brush 10 may be subjected to heat treatment that causes a curving of the bristles, as shown in FIG. 8C, or to beat the brush 10 so as to create a zone of weakness 23 on the bristles 16 that modifies the orientation thereof, in particular for the purpose of reducing or limiting a spiral effect.

Figure 9C:
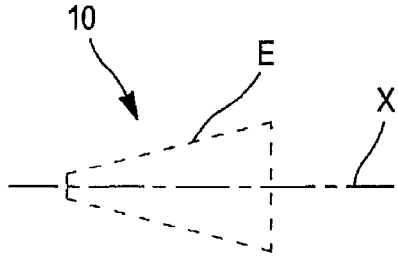
FIGS. 9A to 9E are exemplary side views showing examples of envelope surfaces for a brush according to some embodiments of the present disclosure.
Figure 9E:
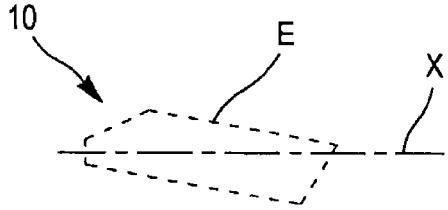
Figure 9D:
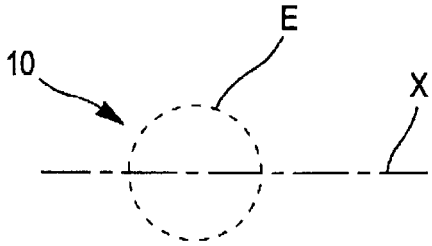
Figure 9A:
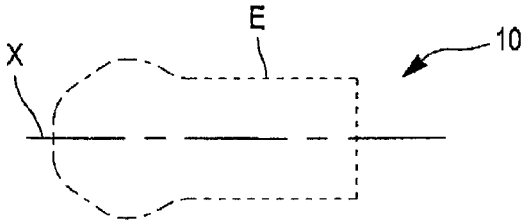

The brush 10 may be made with an envelope surface E having a diameter that varies along the longitudinal axis X of the brush, and, by way of example, that passes via an extremum, as shown in FIG. 9A. The diameter of the bristles 16 for a segment t may vary as a function of the diameter of the brush 10, e.g. so as to use bristles 16 of greatest diameter when the diameter of the brush 10 is at its maximum. Since the flexibility of a bristle 16 increases with its length, it is possible to compensate for the greater flexibility due to the increase in length by increasing the diameter of the bristle 16.

In a variant, the diameter of the bristles 16 may decrease with an increase in the diameter of the brush 10, over at least a fraction of the length of the brush 10, so as to benefit from bristles 16 that are even more flexible.

The diameters of the envelope surfaces of three segments $t_k$, $t_{k+1}$ and $t_{k+2}$ may be ordered like the diameters of the bristles 16 of said segments, or they may follow a reverse order.

Figure 9B:
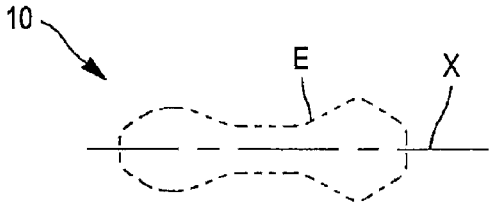

FIG. 9B shows a brush 10 having an envelope surface E of generally peanut shape with three extremums, e.g. two maximums in the proximities of its proximal and distal ends, and a minimum between the maximums.

For such a brush 10, and by way of example, $d_1 < \ldots < d_p > d_{p+1} \ldots > d_q < d_{q+1} \ldots < d_r > \ldots > d_n$, where $d_p$ is the diameter of the bristles 16 of the segment $t_i$ in which the diameter of the brush 10 reaches its first maximum starting from the distal end of the brush, $d_q$ is the diameter of the bristles 16 of the segment in which the diameter is at its minimum between the two maximums, and $d_r$ is the diameter of the bristles of the segment in which the diameter of the brush reaches its second maximum.

FIG. 9C shows a brush 10 having an envelope surface E of section that increases from its distal end to its proximal end. For such a brush, the diameters $d_i$ of the bristles of the various segments increase towards the proximal end of the brush 10. In some other embodiments, the diameters $d_i$ of the bristles 16 of the various segments decrease.

The an envelope surface E of brush 10 may also have the general shape of a ball, as shown in FIG. 9D.

The core 15 may extend with its longitudinal axis X centered for all of the sections of the brush, or, in a variant, it may be off-center, as shown in FIG. 9E.

EXAMPLE

A mascara brush is made with 15 bristles per tuft m and 11 tufts total, the bristles being made of PA-6, and respectively of the following increasing diameters: $^{6}/_{100}$, $^{8}/_{100}$, $^{10}/_{100}$, $^{13}/_{100}$, $^{15}/_{100}$, $^{17}/_{100}$, $^{20}/_{100}$, $^{25}/_{100}$, $^{30}/_{100}$, $^{35}/_{100}$, $^{40}/_{100}$.

Naturally, the systems and methods of the present disclosure are not limited to the embodiments described above.

In particular, it is possible to make the brush with other shapes of envelope surfaces E as desired.

The expression "comprising a" should be understood as being synonymous with "comprising at least one" unless specified to the contrary.

Although the present disclosure has been described with reference to particular embodiments, it is to be understood that these embodiments are merely illustrative of the principles and applications of the present disclosure. It is therefore to be understood that numerous modifications may be made to the embodiments and that other arrangements may be devised.

What is claimed is:

1. An applicator for applying a composition to the eyelashes or the eyebrows, the applicator comprising: a handle; a stem projecting from the handle; a brush having a distal free end and a twisted core projecting from the stem and the brush comprising a plurality of segments, disposed along a length of the twisted core each segment of the plurality of segments including a plurality of bristles having a common diameter associated with the segment, and being held by the twisted core, wherein the common diameter for each segment of the plurality of segments increases consecutively for each segment along the length moving from the stem to the free distal end of the twisted core.

2. The applicator according to claim 1, wherein the plurality of bristles associated with each of the at least two segments comprise the same material.

3. The applicator according to claim 1, wherein the plurality of bristles associated with each of the at least two segments have substantially the same shape in cross-section.

4. The applicator according to claim 1, wherein a common diameter of a plurality of bristles associated with each of the at least two segments lies in the range $^{2}/_{100}$ mm to $^{40}/_{100}$ mm.

5. The applicator according to claim 1, wherein a common diameter of a plurality of bristles of each of the at least two segments lies in the range $^{6}/_{100}$ mm to $^{36}/_{100}$ mm.

6. The applicator according to claim 1, wherein the common diameter of the plurality of bristles of a first segment differs from the common diameter of the plurality of bristles of a consecutive segment by a value lying in the range $^{1}/_{100}$ mm to $^{10}/_{100}$ mm.

7. The applicator according to claim 1, wherein the common diameter of the plurality of bristles of a first segment differs from the common diameter of the plurality of bristles of a consecutive segment by a value lying in the range $^{2}/_{100}$ mm to $^{8}/_{100}$ mm.

8. The applicator according to claim 1, wherein the brush comprises at least three segments, the common diameter of the plurality of bristles associated with each of the at least three segments increasing for each segment towards the free distal end of the twisted core.

9. The applicator according to claim 1, wherein the brush comprises 4 to 25 segments, the common diameter of the plurality of bristles associated with each of the 4 to 25 segments differing between each of the 4 to 25 segments.

10. The applicator according to claim 1, wherein the plurality of bristles associated with a particular segment includes between 2 to 300 bristles.

11. The applicator according to claim 1, wherein the plurality of bristles associated with a particular segment includes between 10 to 60 bristles.

12. The applicator according to claim 1, having an envelope surface of the brush that is not circularly symmetrical about a longitudinal axis of the brush.

13. The applicator according to claim 12, wherein a cross-section of the envelope surface varies based on a function of the diameter of the bristles.

14. The applicator according to claim 1, wherein, except for a proximal segment at a proximal end and a distal segment at the free distal end of the brush, the common diameter of the plurality of bristles for each of the at least two segments alternates between a larger diameter and a smaller diameter.

15. The applicator according to claim 1, wherein the plurality of bristles associated with each of the at least two segments differs in cross-sectional shape between each of the at least two segments.

16. The applicator according to claim 8, wherein the plurality of bristles associated with each of the at least three segments differs in cross-sectional shape between each of the at least three segments.

17. A method of manufacturing a twisted-core brush of an applicator as defined in claim 1, the method comprising:

disposing at least two tufts of bristles between two branches of a wire, the bristles of each tuft having a common diameter different from the bristles of the other tuft; and twisting the branches together.

18. A method of manufacturing a twisted-core brush of an applicator as defined in claim 1, the method comprising:

disposing at least three tufts of bristles between two branches of a wire, the bristles of each tuft having a common diameter different from the bristles of the other tufts; and twisting the branches together.

19. The method according to claim 18, wherein each of the at least three tufts has 10 to 200 bristles.

20. The method according to claim 18, wherein a color associated with the bristles of at least one of the at least three tufts differs from a color associated with another of the at least three tufts.

21. An applicator for applying a composition to the eyelashes or the eyebrows, the applicator comprising: a handle; a stem projecting from the handle; a brush having a distal free end and a twisted core, projecting from the stem and comprising at least three segments disposed along a length of the twisted core, each segment including a plurality of bristles having a common diameter associated with the segment, and being held by the twisted core, wherein the common diameter of the plurality of bristles for each of the at least three segments increases, consecutively for every segment along the length moving from the stem to the distal end of the twisted core.

* * * * *